United States Patent [19]

Bintz et al.

[11] 4,195,474

[45] Apr. 1, 1980

[54] LIQUID-COOLED TRANSITION MEMBER TO TURBINE INLET

[75] Inventors: Miles F. Bintz, Schenectady, N.Y.; Raymond L. Dehmer, deceased, late of Clifton Park, N.Y., by Mary Mae Dehmer, administrator

[73] Assignee: General Electric Company, Schenectady, N.Y.

[21] Appl. No.: 842,400

[22] Filed: Oct. 17, 1977

[51] Int. Cl.[2] ..... F02C 7/12; F01D 25/12; F28F 3/12

[52] U.S. Cl. ..... 60/730; 415/176; 165/51; 165/169; 60/39.37

[58] Field of Search ..... 60/39.66, 267; 165/169, 165/173, 175, 176, 51; 415/116, 175, 176

[56] References Cited

U.S. PATENT DOCUMENTS

| | | | |
|---|---|---|---|
| 1,525,682 | 2/1925 | Lowry et al. | 165/169 |
| 1,798,160 | 3/1931 | Holzwarth | 415/176 |
| 2,479,573 | 8/1949 | Howard | 60/39.66 |
| 2,806,355 | 9/1957 | Schorner | 60/39.66 |
| 2,992,529 | 7/1961 | Sampietro | 60/39.66 |
| 3,490,747 | 1/1970 | De Corso et al. | 60/39.66 |
| 3,651,645 | 3/1972 | Grieb | 60/39.66 |
| 3,652,181 | 3/1972 | Wilhelm | 60/39.66 |
| 3,736,747 | 6/1973 | Warren | 60/39.66 |
| 3,849,983 | 11/1974 | Cherry | 60/267 |

FOREIGN PATENT DOCUMENTS

| | | | |
|---|---|---|---|
| 2092897 | 1/1972 | France | 165/169 |

*Primary Examiner*—Carlton R. Croyle
*Assistant Examiner*—Thomas I. Ross
*Attorney, Agent, or Firm*—Jerome C. Squillaro

[57] ABSTRACT

An improved structure is provided for liquid cooling a transition member which conducts hot motive gases from a combustor to a turbine inlet in a gas turbine power plant. The liquid-cooled structure includes a transition member body having a longitudinal inlet manifold and a longitudinal collection manifold attached to opposite sides of the body. The body has a plurality of internal laterally disposed passages which communicate liquid coolant from the inlet manifold, around the body to the collection manifold. The liquid coolant transfers heat from the member in a circumferential flow pattern; then the coolant is discharged from the member by a discharge manifold which is connected to the collection manifold. The method of manufacturing of the transition member provides for forming the body in two mating half subassemblies having internal coolant passages. Each half of the body is blanked from a flat sheet having a shape conforming to the developed shape of the body. Lateral slots are machined on the surface of the sheet. The coolant passages are formed by diffusion bonding a metallic skin over the slotted surface in one method and by embedding tubular members in the slots in an alternate method. The subassemblies are then formed into the contoured shape of the body. The subassemblies and components forming the manifolds are welded together to form the transition member.

1 Claim, 7 Drawing Figures

LIQUID-COOLED TRANSITION MEMBER TO TURBINE INLET

BACKGROUND OF THE INVENTION

1. Field of the Invention

The present invention relates generally to gas turbine power plants, and more particularly, to an improved construction for cooling of the transition member supplying hot combustion gases from the cumbustor to the turbine. The invention also relates to a method of manufacture of the transition member.

2. Description of the Prior Art

Industrial gas turbines generally supply compressor air to a housing surrounding one or more combustors within which combustion takes place for supplying gases to the turbine. Each combustor has an open cylindrical outlet known as a combustion liner. The outlet of each combustion liner is generally located some distance away from the inlet of the turbine. To conduct the hot gases from the combustion liner outlet to the turbine nozzle inlet passage, there is provided a transition member.

A problem encountered in gas turbines is that of cooling the transition member. The hot combustion gases combined with fuel contaminants may produce a rapid oxidation and corrosion of the member at high temperatures. This is known as hot corrosion. The high temperatures can also increase the thermal gradients within the member and produce higher thermal stresses. To reduce the effects of hot corrosion, it would be desirable to limit the internal surface temperature of the transition piece to approximately 1000° F. In addition, a uniform temperature is desired to minimize the thermally induced stresses.

The prior art in conventional gas turbines has utilized a portion of the compressor air in several ways to cool the member. Some turbine designs circulate compressor air around the member en route to the combustor for convective cooling of the member. Where additional cooling is required, transition members are provided with apertures so that a portion of the compressor air enters the member and thereby provides a cooling film between the flow of combustion gases and the inner surface of the member. Another prior art configuration, disclosed in U.S. Pat. No. 3,652,181 to Wilhelm, provides a double-walled cooling sleeve for circulating compressor air around a portion of the member. The foregoing cooling methods are generally thought to be sufficient in gas turbines that operate in a range of turbine inlet temperatures up to about 2100° F.

However, particular cooling problems exist in the design of ultra-high temperature gas turbines which are to operate at a firing temperature in the range of 2800° F. At such extreme firing temperature, a substantial amount of heat must be transferred away from the inner surface of the transition member.

The prior art has considered the flow of liquid coolant to transfer heat in non-related areas of power plant design, such as the cylinder block of an internal combustion piston engine. The high heat capacity of a liquid, such as water, would be well-suited to maintain the metal temperature of the transition member at levels where thermal stress and resistance to hot corrosion would be acceptable. However, problems are encountered in developing a liquid coolant distribution system which can efficiently and uniformly transfer heat from the complex-shaped member and also be readily manufacturable. Particular manufacturing problems are encountered in requirements for subassembled major components, requirements of quality control pressure testing and flow checking prior to final installation.

Accordingly, one object of the present invention is to provide a construction for a transition member in a gas turbine in which the member is effectively cooled with liquid coolant.

Another object of the invention is to provide a construction for a liquid-cooled transition member in which the member is cooled uniformly.

Another object of the invention is to provide a construction for a liquid-cooled transition member which can be readily manufactured.

It is still a further object of the invention to provide a construction for a liquid-cooled transition member which can be manufactured in major subassemblies which permit pressure testing and flow checking prior to final assembly.

SUMMARY OF THE INVENTION

The invention is directed to a liquid-cooled transition member for conducting hot combustion gases from a combustion liner to a turbine inlet passage. The transition member includes a contoured body having one end generally circular, conforming to the shape of the combustion liner, and the other end generally rectangular conforming to the shape of the turbine inlet passage. An inlet manifold adapted for receiving liquid coolant is attached longitudinally along the outer radial centerline of the body. An outlet collection manifold is attached longitudinally along the inner radial centerline of the body. The body has a plurality of internal laterally disposed passages which communicate liquid coolant from the inlet manifold around the body to the collection manifold. A circumferential discharge manifold is connected to the collection manifold and circulates the liquid coolant around the combustion liner end of the member and then exhausts the coolant from the member. The flow of liquid coolant thereby transfers heat from the member in a lateral circumferential flow pattern.

The lateral circumferential flow pattern allows the member to be manufactured in basic subassemblies; namely, two mating halves which are attached to form the body and a circumferential discharge manifold attachable to the body. The method of manufacture includes blanking a flat sheet conforming to the shape of the developed body half; forming lateral slots on the inner surface of the flat sheet; forming connecting passages intersecting each slot through the sheet near the longitudinal edges of the sheet; bonding a metallic skin to the slotted inner surface of the sheet, thereby forming lateral coolant passages in the sheet; forming the skin-bonded sheet into the required contoured shape of the body subassembly; attaching the body subassemblies together; attaching the longitudinal inlet manifold and the collection manifold over the corresponding seams of the body connection and over the connecting passages communicating the manifold with the coolant passages; connecting the circumferential discharge manifold subassembly to the collection manifold and attaching the discharge manifold subassembly to the body.

BRIEF DESCRIPTION OF THE DRAWINGS

While the novel features of the invention are set forth with particularity in the appended claims, the invention will be better understood along with other objects and features thereof from the following detailed description taken in conjunction with the drawing, in which:

DESCRIPTION OF THE PREFERRED EMBODIMENT

Figure 1:
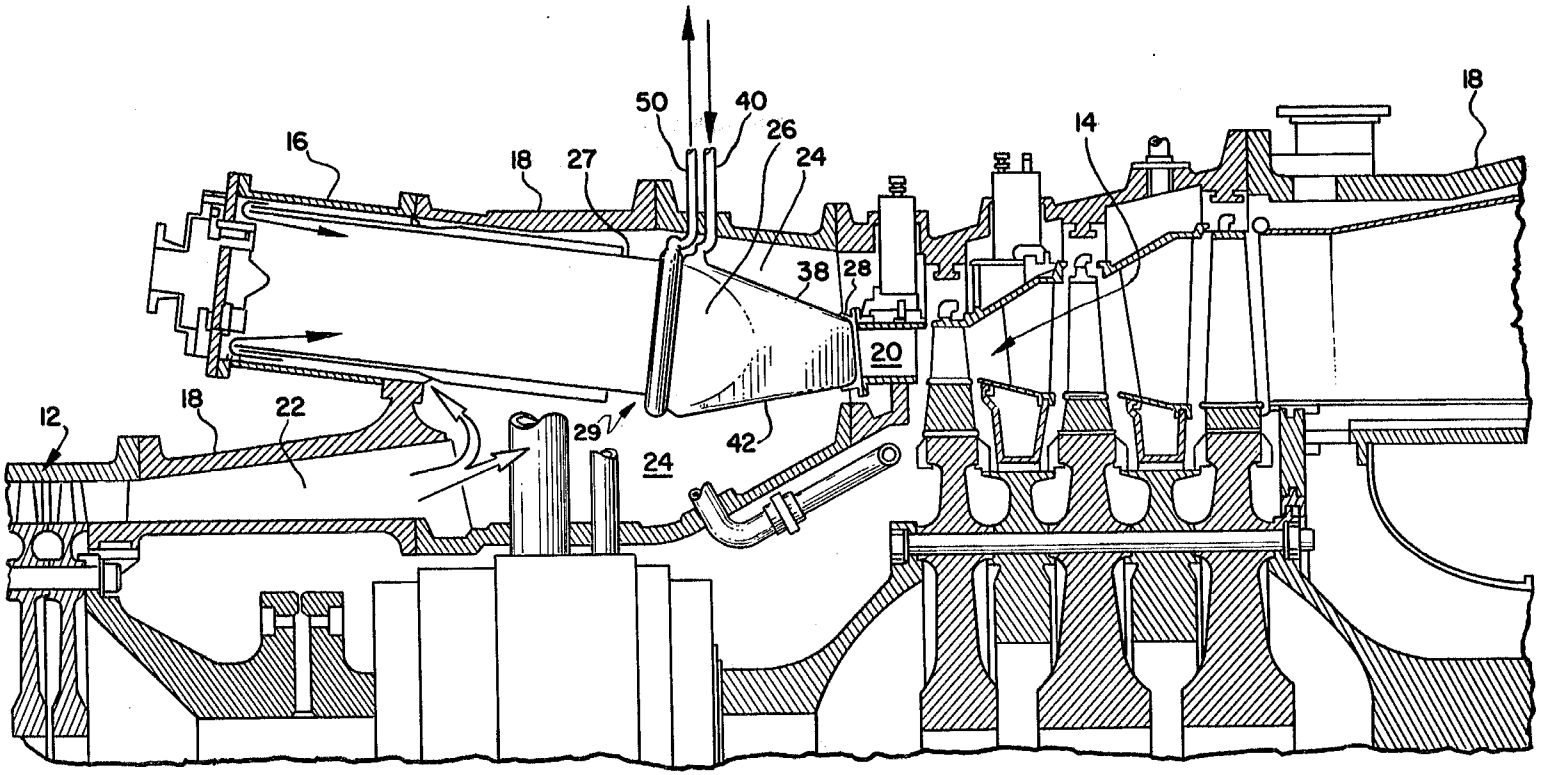
FIG. 1 is a side elevational view in partial cross-section diagrammatically showing a heavy duty gas turbine employing the liquid-cooled transition member of this invention.
Figure 2:
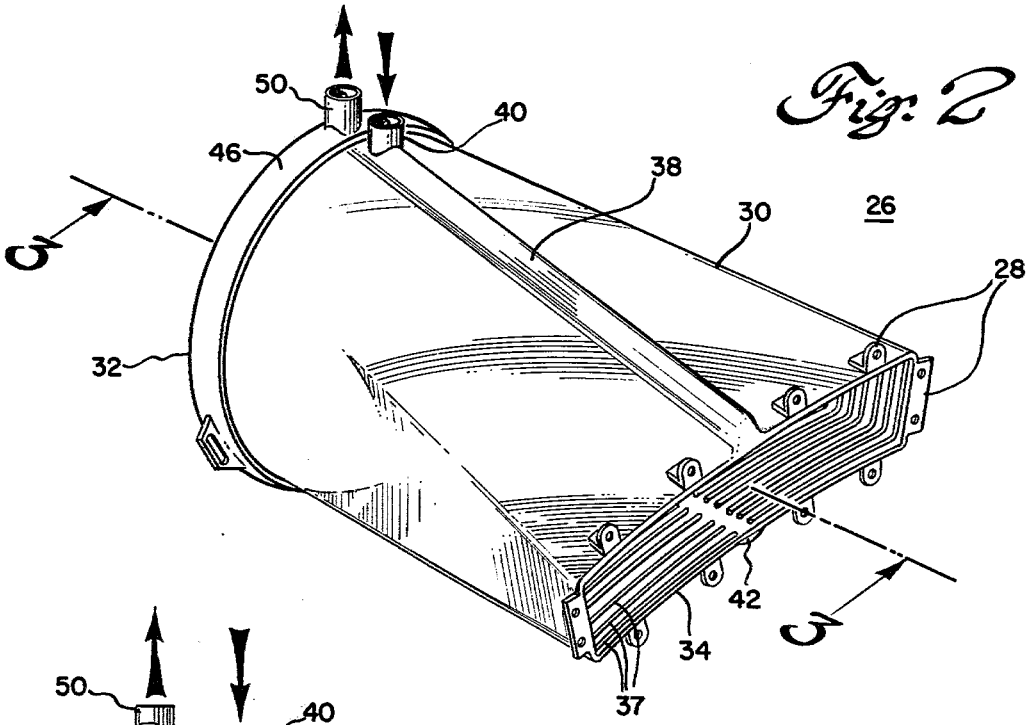
FIG. 2 is an enlarged perspective view of the transition member shown in FIG. 1.
Figure 3:
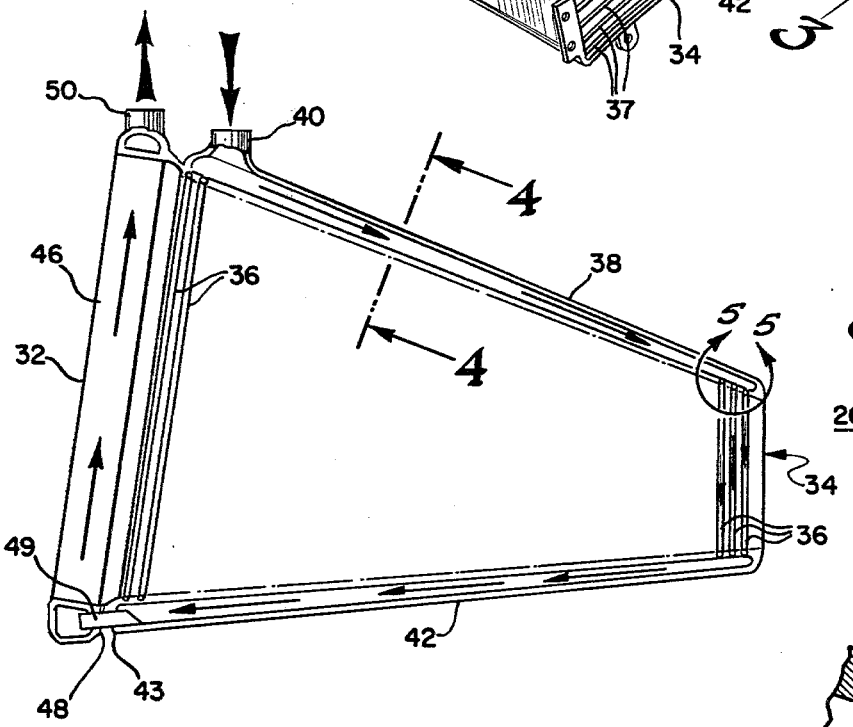
FIG. 3 is a cross-sectional view taken along line 3—3 of FIG. 2.

Referring first to FIG. 1, there is shown a portion of an axial flow gas turbine power plant 10 showing a portion of a compressor 12, a portion of a turbine 14, and a combustor 16 within an outer casing 18. The turbine 14 has an arc of radially extending stationary nozzle partitions which form a turbine arcuate inlet passage 20. The compressor 12 has an outlet 22 which discharges into a chamber 24 and the compressed air is directed from the chamber into the combustor 16 to mix with fuel (not shown) to form a combustible mixture which is burned to provide the hot motive gases.

In order to direct the hot motive gases from the combustor to the turbine, a transition member 26 is provided. The transition member 26 is connected at one end to a combustion liner 27 of the combustor 16 and connected at the other end to the turbine inlet passage 20. The transition member is suitably contoured to provide flow transition from a circular inlet to a generally rectangular outlet. A plurality of such transition members 26 and combustion liners 27 are circumferentially disposed around the gas turbine (only one being shown). The transition member 26 is securely attached to the inlet passage 20 by flanges 28 and is expandably attached by a spring-sealed connection 29 around combustion liner 27. The expandable attachment allows the member to thermally expand as the temperature of the member increases, thereby minimizing thermal stress. Compressor discharge from outlet 22 provides compressed air which circulates at approximately 700° F. compressor air to enter transition member 26 and provide film cooling along the inner surface of the member. The foregoing construction is well known in the art.

The present invention comprises an improvement in the construction of the transition member 26 which provides passages for the flow of liquid coolant. The flow of liquid coolant transfers heat from the transition member and thereby minimizes hot corrosion of the material forming the member.

Figure 4:
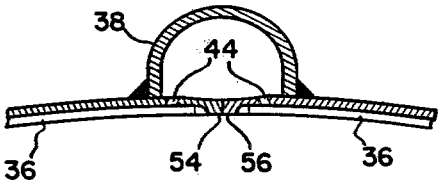
FIG. 4 is a cross-sectional view of a manifold taken along line 4—4 of FIG. 3.
Figure 5:
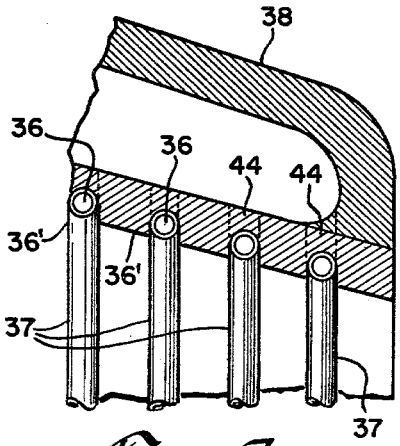
FIG. 5 is an enlarged detail of the area enscribed by line 5—5 of FIG. 3, showing one embodiment of the transition member employing embedded tubular coolant passages.

Referring to FIGS. 2, 3, 4 and 5, there are shown enlarged views of transition member 26. The member is oriented axially in reference to the power plant and flow of hot motive gases through the member. The member 26 includes a contoured body 30 having one circular end 32 conforming to the shape of the combustion liner 27 (shown in FIG. 1) and one generally rectangular end 34 conforming to the shape of the arcuate turbine inlet passage 20 (shown in FIG. 1). The body 30 has a plurality of liquid coolant passages 36 laterally disposed within the contoured inner surface. Coolant passages 36 are oriented in a lateral configuration, transverse to the flow of hot motive gases through member 26. The lateral configuration, transverse to the flow of hot motive gases through member 26. The lateral configuration provides uniform parallel distribution of liquid coolant around the complex shape and facilitates a more uniform operating temperature of the member. The passages 36 are provided in the embodiment shown in FIGS. 2-5 by embedding tubular member 37 in slots 36′ which are machined in body 30 as shown in FIG. 5. The lateral configuration of the passages provide a particular manufacturing advantage in that the formation of the body is generally perpendicular to the orientation of the passages. The orientation makes it possible to machine slots 36′ and braze tubular members 37 in the slots while the body 30 is in the form of a flat sheet. Because the coolant passages 36 within tubular members 37 extend transversely to the axis of bending of the sheet, the bending of the surface of the sheet into the contoured shape of body 30 is substantially perpendicular to the axis of each coolant passage. The bending of coolant passages 36 in a direction perpendicular to the axes of the passages minimizes distortion of the passages.

An inlet manifold 38 extends longitudinally along the outer radial centerline of body 30. The inlet manifold 38 has an inlet 40 adapted to receive liquid coolant. An outlet collection manifold 42 extends longitudinally along the inner radial centerline of body 30. The outlet manifold has an opening 43 adapted for conducting coolant out of the outlet manifold.

Figure 6:
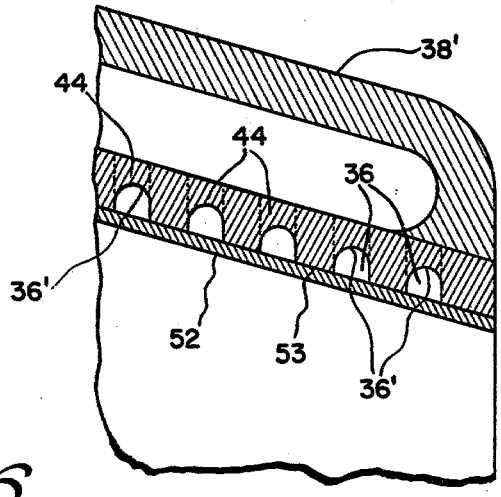
FIG. 6 is a cross-sectional view similar to FIG. 5 showing an alternate embodiment having diffusion-bonded skin forming coolant passages.

Body 30 has a plurality of connecting passages 44 intersecting each coolant passage 36 through which liquid coolant communicates from inlet manifold 38 to passages 36 as shown in FIGS. 4, 5 and 6. Connecting passages 44 on the opposite side of body 30 communicate coolant from passages 36 to collection manifold 42. Heat is thereby transferred from member 26 to the liquid coolant while the coolant follows a lateral circumferential flow pattern.

A circumferential discharge manifold 46 having an inlet boss 48 is connected to the opening 43 of collection manifold 42 by a jumper tube 49. The manifold 46 has an outlet 50 adapted to exhaust the liquid coolant from the transition member.

Referring to FIG. 6, there is shown an alternative embodiment of the invention. In this embodiment the coolant passages 36 are provided by attaching a layer of material 52 to surface 53. The layer of material 52 covers the laterally oriented slots 36′ to form passages 36. This embodiment is otherwise as described in FIGS. 2-4. The coolant passages 36 are oriented relative to the contoured bending of the body as previously described so that the material 52 can be attached to the slotted surface 53 while the surface is flat and remains substantially free from distortion after the body is formed.

Referring again to FIG. 1, in operation of a specific embodiment, an exemplary gas turbine power plant 10 having 16-inch diameter liners 27 which discharge the combustion gas at 2800° F. into the turbine inlet passages 20, through transition member 26. The liquid coolant (water) operating temperature range was selected to provide an inlet temperature of 225° F. and a maximum outlet temperature of 572° F. to keep below the saturation temperature provided by a 1500 psi water delivery system. The coolant passages were designed assuming an approximate temperature increase of 225° F. The analytical heat balance of the transition member utilizing 52 equally spaced slots each having a 0.12 inch × 0.08 inch cross-section, and a flow velocity of 11.2 feet per second resulted in an average metal temperature of 800° F. which is well within a 1000° F. design limit. The water enters transition member 26 at inlet 40 at a temperature of 225° F. and at a pressure of 1500 psi, and fills manifold 38. The water then distributes through the cross-flow passages 36 into two 180° circumferential flow paths around the walls of the member to the collection manifold 42 positioned along the inner radial centerline of the member. During this pass, the water temperature increases from 225° F. to approximately 450° F. The water flows under pressure of 1500 psi through the collection manifold and into discharge manifold 46, where the water flows around the manifold to outlet 50.

The inlet 40 and the outlet 50 located at the outer radial centerline of each transition member 26 facilitate assembly and maintenance of the water-cooled system.

The above-described structure not only provides for efficiently cooling a transition member with liquid coolant, but also provides a structure in which the member is cooled uniformly. Another advantage of the structure is that its features and configuration facilitate efficient manufacture and facilitate efficient installation and maintenance of the liquid-cooling system.

Figure 7:
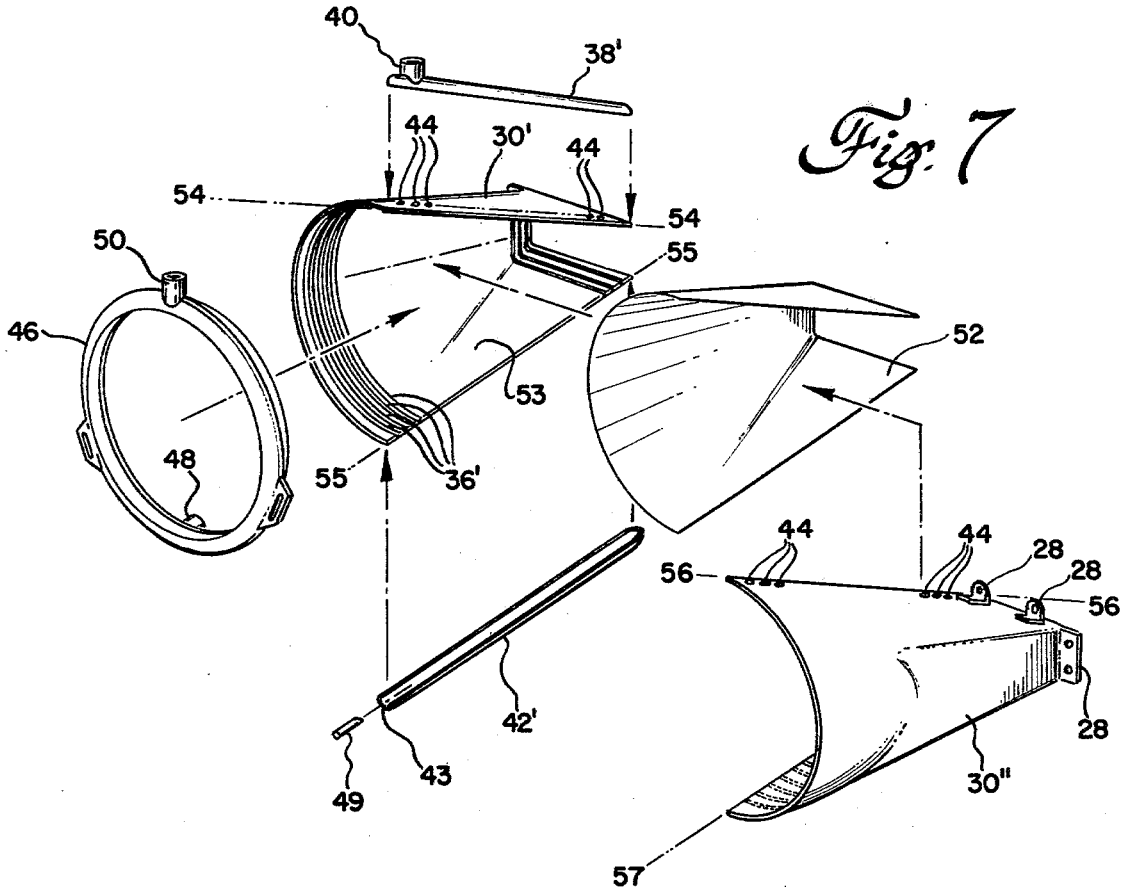
FIG. 7 is an exploded perspective view showing a method of fabrication and assembly of an embodiment of the transition member of this invention.

Referring now to FIG. 7, there are shown the subassemblies and components which provide an advantageous method of manufacturing an embodiment of transition member 26. As shown in FIG. 7, the body 30 is formed in two mating halves comprising subassemblies 30′ and 30″. The additional components include the circumferential discharge manifold 46, a semicylindrical housing 38′ which includes the inlet 40 and which forms an outer wall of inlet manifold 38, and a semicylindrical housing 42′ which includes the opening 43 and which forms an outer wall of collection manifold 42.

In forming subasssembly 30′, a flat sheet (shown formed) is first blanked out in a shape conforming to the developed shape of subassembly 30′. Slots 36′ are then machined in the inner surface of the sheet while the sheet is flat. As previously discussed in reference to FIG. 2, the transverse orientation of the passages 36 relative to the contoured shape of subassembly 30′ permits the slots 36′ to be machined while the sheet is flat, and still remain substantially free of distortion when the sheet is bent into the required shape. The machining of slots 36′ while the sheet is flat is of significant manufacturing advantage and permits the subassembly 30′ to be economically and efficiently produced. The slots 36′ are also generally straight and parallel and can be sighted-through and visually inspected for any obstruction or discontinuity of the slots after machining. Passages 44 are then machined intersecting each slot 36′ through the outer surface and near the longitudinal edges 54 and 55 of the sheet. A layer of material 52, such as a metallic skin, is bonded to slotted surface 53 to form the liquid coolant passages 36 in the subassembly. A preferred bonding method is the method known as diffusion bonding. The straight parallel passages 36 are of particular manufacturing advantage at this time for visual inspection because foreign matter could collect in the passages during diffusion bonding. Any foreign matter which may have collected in the passages could be reamed or otherwise readily removed from the straight passages at this time, prior to bending. The sheet having material 52 bonded to surface 53 is then formed into the required contoured shape of the subassembly 30′.

As stated above, the passages 36 are substantially perpendicular to the bending axis as the sheet is formed into the countoured shape of subassembly 30′. The bending of coolant passages 36 in a direction perpendicular to the axes of the passages results in a minimum of distortion of the passages. This minimization of distortion results from the orientation of the passages and permits the substantial manufacturing advantages of forming the slots and bonding the skin to the surface while the sheet is flat.

The resulting diffusion bonded coolant passages 36 are shown generally in FIG. 6. Each passage 36 can be pressure checked and flow tested at this stage of manufacture to timely determine if subassembly 30′ is free of defects prior to final assembly and installation. The most efficient heat transfer to coolant in passages 36 results from forming slots 36′ and bonding material 52 to the inner surface of the transition member to form the passages 36. However, for considerations other than heat transfer, it may be desirable to form passages 36 by forming slots 36′ and bonding material 52 to the outer surface of the member.

As an alternate method of manufacturing subassembly 30′, tubular members 37 can be attached within slots 36′ to form passages 36. The ends of tubular members 37 are plugged or otherwise sealed. Passages 44 are machined intersecting each tubular member 37 through the outer surface and near longitudinal edges 54 and 55 of the sheet. The resulting tubular coolant passages 36 are shown generally in FIGS. 4 and 5.

Subassembly 30″ is formed similarly as subassembly 30′. The subassemblies are attached along their common longitudinal edges, 54 to 56 and 55 to 57, to form body 30 having longitudinal seams along the outer radial centerline and the inner radial centerline. The inlet manifold 38 and outlet collection manifold 42 are formed by welding the semi-cylindrical housings 38′ and 42′ over the connecting passages 44 which are adjacent the longitudinal seams.

The circumferential discharge manifold 46 (shown assembled) is formed by welding inlet boss 48 and an outlet 50 to a U-shaped ring forging having a cover. Of course, manifold 46 can be fabricated from a variety of mating components resulting in the required function and configuration of the manifold. A particular manufacturing advantage is that manifold 46 can be pressure tested and flow checked between inlet boss 48 and outlet 50 prior to final assembly. The manifold 46 is connected at inlet boss 48 by a jumper tube 49 to opening 43 in outlet manifold 42. The manifold 46 is then securely attached to body 30.

The general means of attaching the metallic subassemblies and components together is that of welding; however, it should be realized that any other method which securely bonds the mating components together can be an alternative method.

Each assembled transition member 26 can be timely pressure checked and flow tested at inlet 40 and outlet 50 prior to final installation within the power plant.

A liquid-cooled transition member can be readily manufactured by the above-described method. The transition member can be manufactured by forming major subassemblies which provide for efficient mass production and which permit pressure testing and flow checking of the subassemblies in addition to pressure testing and flow checking of the final assembly.

While specific embodiments of the present invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. In a gas turbine including a combustion liner and a turbine, a transition member for conducting hot combustion gas from the combustion liner to an inlet passage of the turbine, said transition member comprising:

a contoured body having an inlet end of circular cross-section conforming to the shape of the exit end of the combustion liner and an exit end of generally rectangular cross-section conforming to the shape of the turbine inlet passage;

an inlet manifold having an inlet adjacent the inlet of said body adapted to receive liquid coolant, said inlet manifold extending longitudinally along and in intimate contact with said body;

an outlet collection manifold having an outlet adjacent the inlet of said body adapted to exhaust the liquid coolant, said outlet collection manifold extending longitudinally along and in intimate contact with said body;

said body having a plurality of laterally disposed passages communicating liquid coolant between said inlet manifold and said collection manifold for transferring heat from said body to the liquid coolant as the coolant follows a lateral circumferential flow pattern.

* * * * *